US009676091B2

(12) United States Patent
Kania

(10) Patent No.: US 9,676,091 B2
(45) Date of Patent: Jun. 13, 2017

(54) 10-IN-1 MULTIPLE FUNCTION WRENCH

(71) Applicant: Test Rite International Co., Ltd., Taipei (TW)

(72) Inventor: Tony Kania, Scottsdale, AZ (US)

(73) Assignee: Test Rite International Co., LTD, Taipei (TW)

( * ) Notice: Subject to any disclaimer, the term of this patent is extended or adjusted under 35 U.S.C. 154(b) by 235 days.

(21) Appl. No.: 14/321,832

(22) Filed: Jul. 2, 2014

(65) Prior Publication Data

US 2016/0001434 A1 Jan. 7, 2016

(51) Int. Cl.
*B25F 1/00* (2006.01)
*B25B 13/14* (2006.01)

(52) U.S. Cl.
CPC ..... *B25F 1/003* (2013.01); *B25B 13/14* (2013.01); *B25F 1/006* (2013.01)

(58) Field of Classification Search
CPC .. B25B 13/14; B25F 1/00; B25F 1/003; B25F 1/006
See application file for complete search history.

(56) References Cited

U.S. PATENT DOCUMENTS

D320,725 S 10/1991 Rubesh
5,209,144 A * 5/1993 Lu Guoji ..... B25B 7/02 81/135
5,237,715 A * 8/1993 Bane, III ..... B25F 1/006 7/139
6,349,621 B1 * 2/2002 Khachatoorain ..... B25B 13/28 81/111
D481,597 S 11/2003 Hsieh
2008/0022815 A1 1/2008 Farrell
2010/0199814 A1 * 8/2010 Lee ..... B25B 13/04 81/177.1
2011/0162150 A1 * 7/2011 Yu ..... B25F 1/006 7/139
2012/0110745 A1 * 5/2012 Hanlon ..... B25F 1/00 7/138
2012/0247281 A1 * 10/2012 Foltyn ..... B25B 13/46 81/177.8

* cited by examiner

*Primary Examiner* — Robert Scruggs
(74) *Attorney, Agent, or Firm* — Treasure IP Group, LLC

(57) ABSTRACT

A multifunctional hand tool is provided, having an adjustable wrench head and an elongated handle extending from the wrench head. The handle is oriented transverse to the wrench head and that defines a plurality of wrench apertures of different sizes. Each wrench aperture defines an axis of rotation for operable use oriented substantially transverse to the first axis of rotation. The wrench head further comprises a hammer and the elongated handle further comprises a nail pull structure. The wrench head can further include a grip texture on an outer surface thereof to facilitate use of the wrench apertures or the nail pull defined by the wrench handle. The outer surface of the handle further includes grip features or textures to facilitate use of the hammer. The adjustable wrench can be changed to a pipe wrench.

17 Claims, 6 Drawing Sheets

One of the operable use of the hammer head is to swing in the x, y plane.

10-IN-1 MULTIPLE FUNCTION WRENCH

FIELD OF THE INVENTION

The present invention relates to a hand tool, and more particularly to a multi-purpose hand tool, which not only provides an adjustable wrench and a pipe wrench, but also integrates a hammer structure, a nail pull structure and three apertures capable of accommodating six different sizes.

BACKGROUND OF THE INVENTION

Handheld tools are generally designed very effective for their specific prescribed purposes. For example, many wrenches of fixed sizes are typically configured with just one or two different size heads. A user, however, must need to own a collection of the different sizes of the same wrench in order to cover the different needs from time to time. In addition, when a job is unknown, the user will have to take an entire collection of tools, including at least a wrench, a hammer and a nail puller to the job site.

Therefore there is a need to invent a single tool having integrated structures, which can provide multiple functions and be used for a variety of applications, to reduce the number of tools required when going to a job site with unknown tasks.

SUMMARY OF THE INVENTION

The instant invention provides a multifunctional hand tool in a shape that substantially resembles a wrench. The multifunction hand tool functions as an adjustable crescent wrench, a pipe wrench, a hammer, a nail puller and three different sizes of apertures, with each aperture able to accommodate both SAE and metric sized bolts. The wrench disclosed herein is exchangeable between a heavy-duty crescent wrench and a pipe wrench.

In a first aspect of the present invention, the multifunctional hand tool comprises an adjustable crescent wrench. The adjustable crescent wrench comprises a wrench head and elongated wrench handle. The wrench head and wrench handle are connected through a joining member. The wrench head comprise a stationary jaw and a movable jaw. The stationary jaw has a first engaging surface, which is substantially flat, situated in a plane includes z axis. The first engaging surface can rotate around the z axis. The movable jaw has a second engaging surface, which is also substantially flat having no teeth or grooves. The second engaging surface faces to the first engaging surface. The movable jaw moves through a sliding channel and adjusted by screw drive. The movable jaw can be completely de-attached from the multifunctional hand tool.

The joining member joins the wrench head and wrench handle. The joining member is twisted, having a groove that a user's thumb can rest comfortably on the twisted joining member.

In a second aspect of the present invention, the multifunctional hand tool comprises a pipe wrench. The pipe wrench comprises a wrench head and elongated wrench handle. The wrench head and wrench handle are connected through a joining member. The wrench head comprise a stationary jaw and a movable jaw. The stationary jaw has an engaging surface, which is substantially flat, situated in a plane including z axis. The first engaging surface can rotate around the z axis. The movable jaw has a third engaging surface, which has teeth or grooves. The movable jaw can be de-attached away from the multifunctional hand tool.

In a third aspect of the present invention, the multifunctional hand tool comprises three wrench apertures, wherein each of the apertures can accommodate two sized elements, both SAE and metric sized elements.

In a fourth aspect of the present invention, the multifunctional hand tool comprises a hammer head. The hammer head is integrally extended from the wrench head to define a closed end of the sliding channel within the wrench head. The hammer head has a hammer face integrally formed at a peripheral surface of the wrench head to provide an added function of the wrench head. The hammer head can hollow or not hollow.

In a fifth aspect of the present invention, the multifunctional hand tool comprises a nail puller. The nail puller is positioned at the tail end of the handle. The nail puller is located symmetrically on the left and right sides of the x axis.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
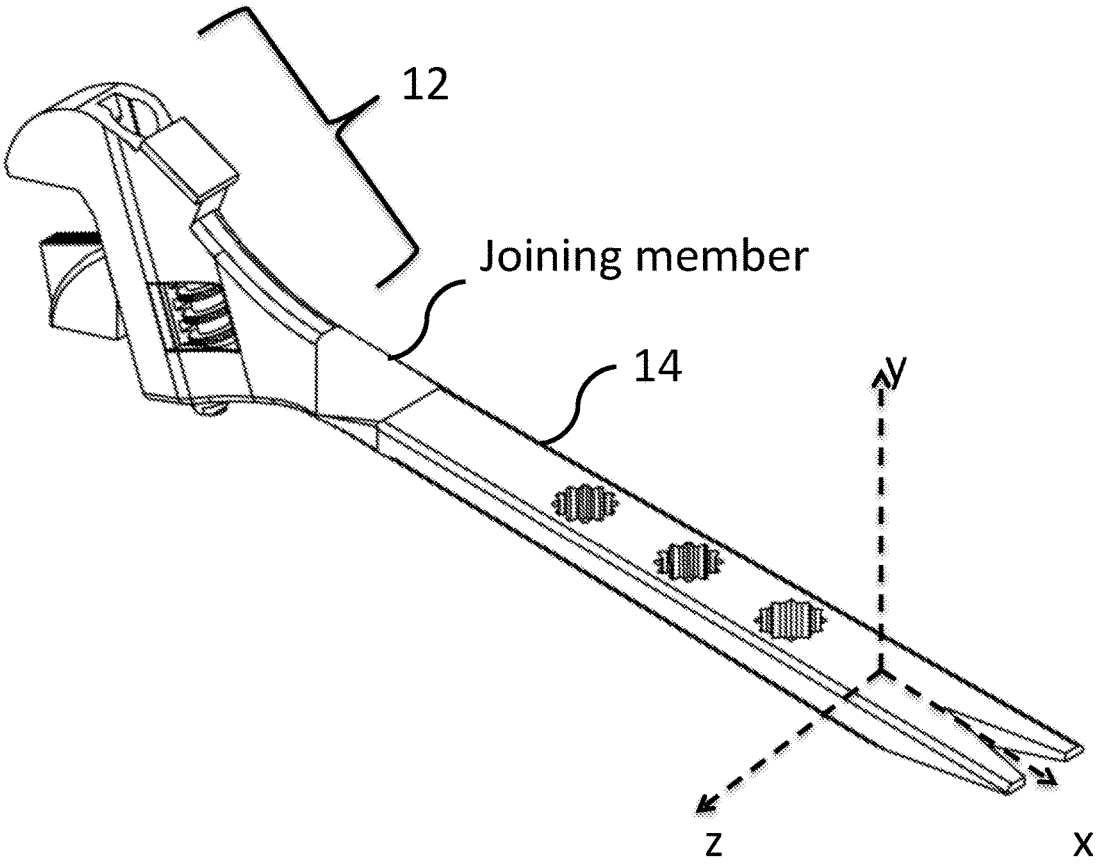
FIG. 1 is a perspective view of a twisted wrench in accordance with the invention.
Figure 2:
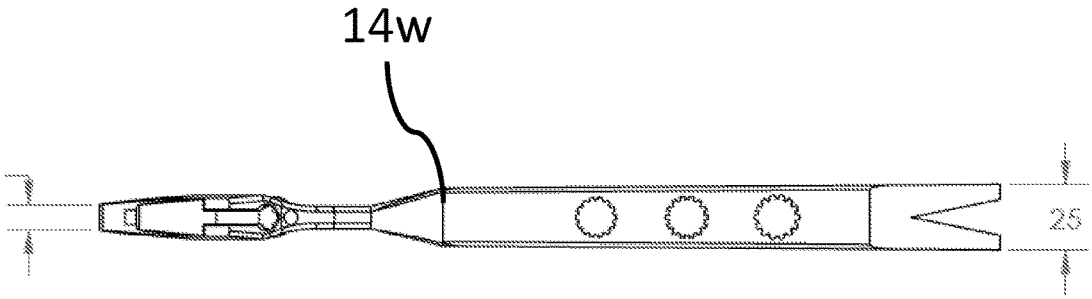
FIG. 2 is a bottom view of the twisted wrench in FIG. 1, wherein the twisted wrench is laid flat on a surface.
Figure 3:
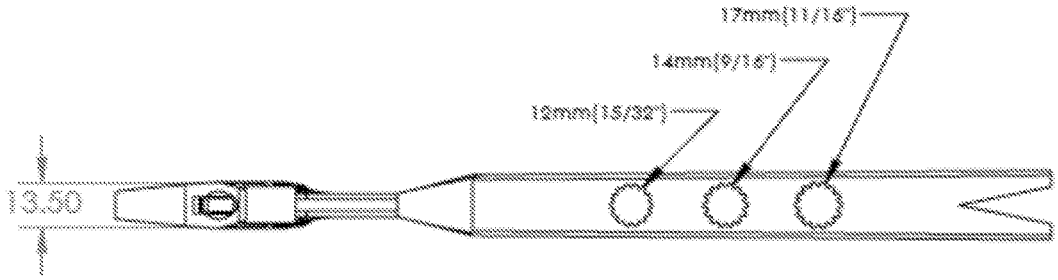
FIG. 3 is a top view of the twisted wrench in FIG. 1, wherein the twisted wrench is laid flat on a surface.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

Three Axes

Referring to FIGS. 1-5, the multifunctional tool is configured as a three dimensional object in an environment, having at least three axes. The wrench handle is defined by a length and width. The length of the wrench is the longer side of the wrench handle. The width of the wrench handle is the shorter side of the wrench handle, as shown as 14*w*. The wrench handle also has a thickness. In one example, the length of the wrench handle defines an x axis, the width of the wrench handle defines a z axis and the thickness of the wrench handle defines a y axis.

A first axis (as illustrated as x-axis), is defined by elongated wrench handle 14 and the tip of the v-shaped nail pull structure. The x-axis is substantially parallel to the length of the elongated handle. A second axis (as illustrated as y-axis) is the rotation axis of one of the apertures. The y-axis forms a 90-degree angle with the x-axis and is parallel to the direction of the thickness of the wrench handle. A third axis, (as illustrated as z-axis) is the axis, is further defined as the axis of rotation for operable use of the wrench head, either as an adjustable wrench or as a pipe wrench. z-axis can also goes through a center of a wrench aperture and is extended along a width of the wrench handle.

In one embodiment, the multifunctional tool is symmetrically configured on the left and right sides of the x-axis.

In another embodiment, when the multifunctional tool is placed in an environment, the wrench handle 14 has a width 14*w*, which is positioned at the boundary between the wrench handle and the joining member. The z-axis is substantially parallel to the width of the wrench handle (14*w* in FIG. 2).

In yet another embodiment, the wrench handle 14 has a surface, which is substantially flat. The surface has a length, which is the long side of the wrench handle, and a width position at the boundary of the wrench handle and joining member. The surface of the wrench handle situated on the plane defined by x and z axes. In one example, the x and z axes form a 90 degree angle.

Adjustable Wrench

In a first aspect of the present invention, the multifunctional hand tool comprises an adjustable crescent like wrench. The adjustable wrench comprises a wrench head and elongated wrench handle. The wrench head and wrench handle are connected through a joining member. The wrench head comprise a stationary jaw and a movable jaw.

The stationary jaw has a first engaging surface, which is substantially flat, situated in a plane including x axis. The engaging surface can rotate around the z axis or an axis parallel to the z axis. In one example, the stationary jaw has no grip textures on the first engaging surface. Optionally, the first engaging surface of the stationary jaw has grip textures, in the form of teeth or grooves.

A movable jaw is positioned opposite to the stationary jaw. The movable jaw is adjustably positioned by a screw drive mechanism. The wrench head further includes a screw drive mechanism for adjusting the position of the movable jaw relative to the stationary jaw. More particularly, the movable jaw includes a rod positioned within a sliding channel. The rod includes a plurality of teeth that interact with the screw drive mechanism to adjust the movable jaw. The screw drive is positioned within an opening disposed below the sliding channel.

The wrench head 12 further includes indicia providing a marker on a scale on a sidewall of the sliding channel. The marker and the scale work in conjunction to indicate the size of the opening defined between the movable jaw and the stationary jaw 30. In an exemplary embodiment, the scale provides a range between zero and one inch, in ⅙th of inch increments. In this manner, a user can precisely set the size of the opening between the movable jaw and the stationary jaw. In other embodiments, other sizes of openings and indicia can be used without departing from the invention. In addition, indicia can be provided on a second side of the wrench head, for example, to provide a second measurement system (e.g., metric measurements).

The movable jaw includes a primary jaw portion and an outer portion. The outer portion has a thickness less than a thickness of the primary jaw portion. The outer portion is generally wedge-shaped such that the outer surface of the gripping portion tapers relative to the second engaging surface of the main jaw portion. In the exemplary embodiment, the outer surface of the gripping portion includes a plurality of ridges oriented to extend across the thickness of the outer portion.

Further, indicia are provided on a first side depicting the size setting for the wrench head. The movable jaw has a second engaging surface. In one example, the second engaging surface is facing to the first engaging surface of the stationary jaw. The second engaging surface is substantially flat. In one example, the second engaging surface does not have any grip textures. In one example, the movable jaw is de-attachable through a sliding channel.

In a second aspect of the present invention, the multifunctional hand tool comprises a pipe wrench. The pipe wrench comprises a pipe wrench head and elongated wrench handle. The pipe wrench head and wrench handle are connected through a joining member. The pipe wrench head comprise a stationary jaw and a movable jaw.

The stationary jaw has the first engaging surface, which is substantially flat, situated in a plane defined by z axis and another axis. The engaging surface can rotate around the z axis. In one example, the stationary jaw has no grip textures on the first engaging surface. Optionally, the first engaging surface of the stationary jaw has grip textures, in the form of teeth or grooves.

A movable jaw is positioned opposite to the stationary jaw. The movable jaw is adjustably positioned by a screw drive. Further, indicia are provided on a first side depicting the size setting for the wrench head. The movable jaw has a third engaging surface. In one example, the third engaging surface is facing to the first engaging surface of the stationary jaw while the second engaging surface is not facing to the first engaging surface of the stationary jaw. For example, the third engaging surface of the movable jaw faces the first engaging surface of the stationary jaw while the second engaging surface of the movable jaw faces outside of the movable the jaw. The third engaging surface is substantially flat. In one example, the third engaging surface has at least one grip texture. The grip textures can be in the form of either teeth or grooves.

In one exemplary embodiment, the multifunctional tool disclosed herein has both adjustable wrench and pipe wrench features integrated in one hand tool. The multifunctional tool can be an adjustable wrench in one user setting and become a pipe wrench in another user setting. The adjustable wrench and pipe wrench can be inter-changeable by de-attaching the movable jaw in one configuration and re-attaching the movable jaw in the other configuration. The movable jaw has two engaging surfaces. In one configuration, the movable jaw has the second engaging surface face the stationary jaw then the wrench is an adjustable wrench, suitable for heavy duty jobs. In the other configuration, the movable jaw has the third engaging surface face the stationary jaw so that the wrench is a pipe wrench. Referring to FIG. 1, the multifunctional tool has a wrench head 12 and an elongated handle 14 extending from the wrench head 12, wherein the movable jaw is in a configuration providing a pipe wrench and wherein the engaging surface of the movable jaw has teeth as a gripping feature.

The joining member joins the wrench head 12 and wrench handle 14. The joining member is twisted, as illustrated in FIG. 1, and has a groove on the twisted joining member that a user's thumb can rest comfortably upon the twisted joining member, which holding the wrench handle 14 and working with the wrench head.

The joining member joins the wrench head with the wrench handle in a unitary construction, being made of a material such as of forged metal.

3 Double Sized Wrench Holes

In a third aspect of the present invention, a box end wrench is disclosed. Along the wrench handle 14, multiple wrench apertures are provided. The wrench apertures can vary in size and number; in addition, in other embodiments the wrench apertures optionally can be configured with other features for engagement.

Box end wrench is used to engage an element. Elements in the present invention, includes nuts, bolts, screws, pipes, and the like.

In accordance with the aspects of the present invention, each wrench aperture as disclosed herein, further has gripping features on the walls of the apertures. Each of the wrench apertures has a spline design, which allows the gripping features such as teeth/grooves to provide grip and two size settings. One size setting is SAE setting and the other size setting is the metric setting. The spline design is a special design, which has only one cut. In one example, the spline design offers an inner groove and outer groove. The size difference between the inner groove and outer groove provides some wiggling room, allowing a SEA or metric sized element at similar size but not exact same size to be able to fit into the same aperture.

Figure 4:
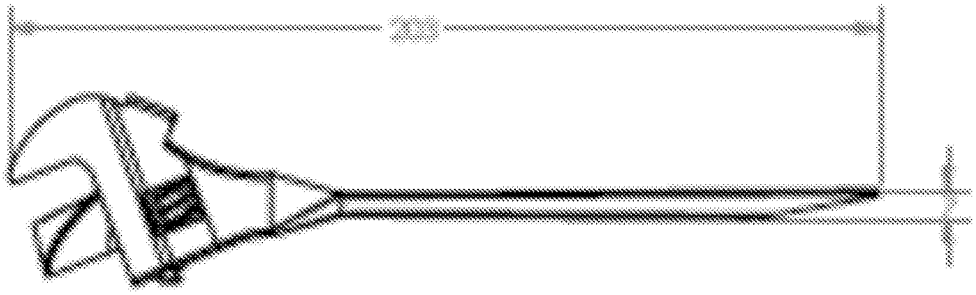
FIG. 4 is a side view of the twisted wrench in FIG. 1, wherein the twisted wrench is laid flat on a surface.
Figure 5:
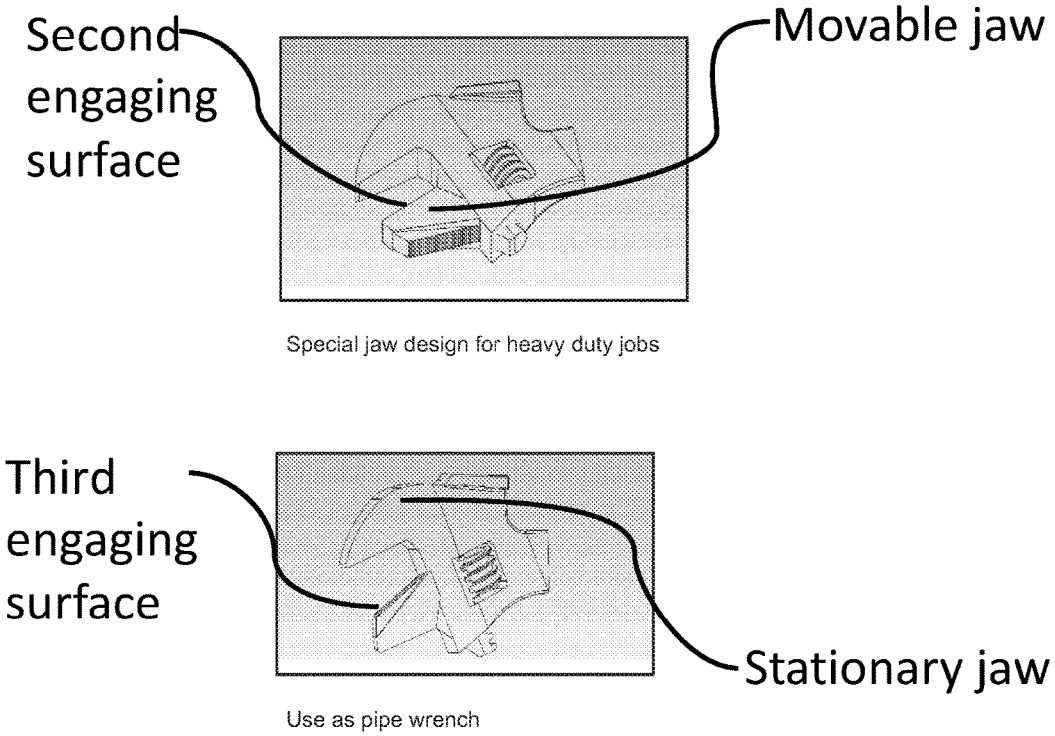
FIG. 5 is two detail views of the twisted wrench in FIG. 1, wherein the top picture illustrates an exemplary adjustable wrench and the bottom picture illustrates an exemplary pipe wrench.

In accordance with the aspects of the present invention, referring to FIG. 4, a first aperture on the wrench handle can accommodate a 12 mm size element. The first aperture can also accommodate a 15/32" sized element. A second aperture on the wrench handle can accommodate a 14 mm sized element. The second wrench aperture can accommodate a 9/16" sized element. A third aperture on the wrench handle can accommodate a 17 mm sized element. The third aperture on the wrench handle can accommodate a 11/16" sized element. Referring to FIG. 4, the wrench apertures are aligned along a longitudinal axis of the wrench handle, wherein the first aperture is positioned next to the second aperture, and the second aperture is positioned next to the third aperture, having the third aperture positioned next to the nail pull end of the wrench handle. Sometimes, the wrench apertures are referred to as box-type wrench heads, or ring spanners.

Figure 6:
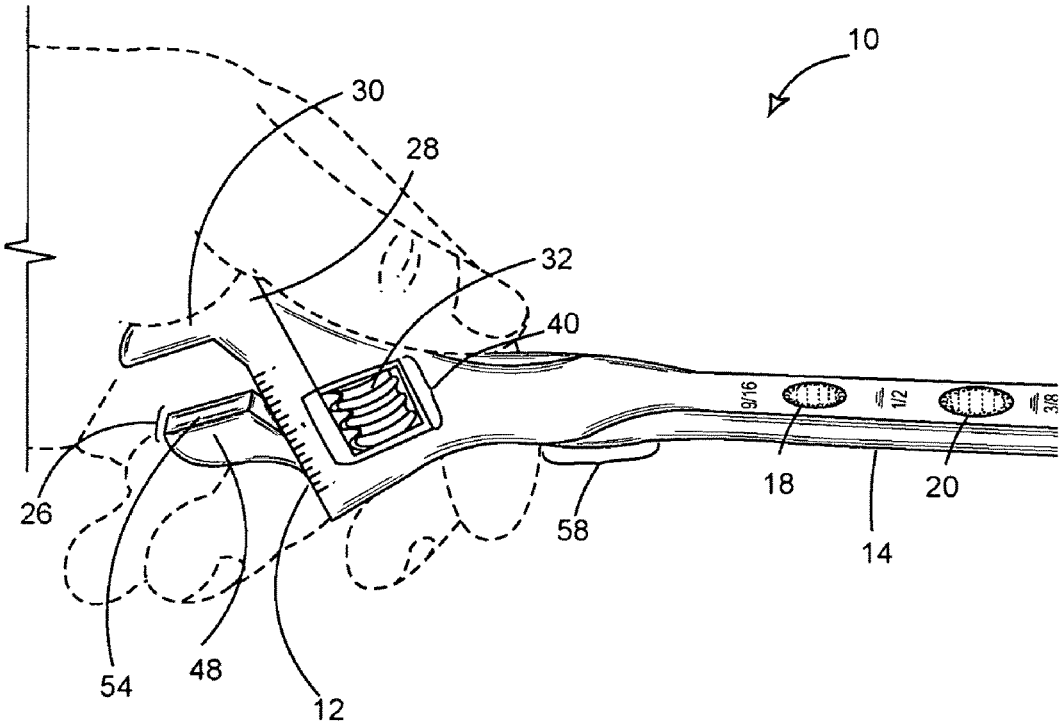
FIG. 6 is a perspective view of a twist wrench, depicting a user holding the wrench.
Figure 7:
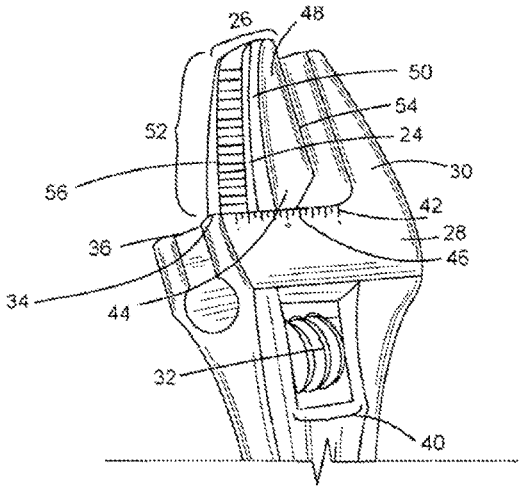
FIG. 7 is a perspective view of a wrench head.
Figure 8:
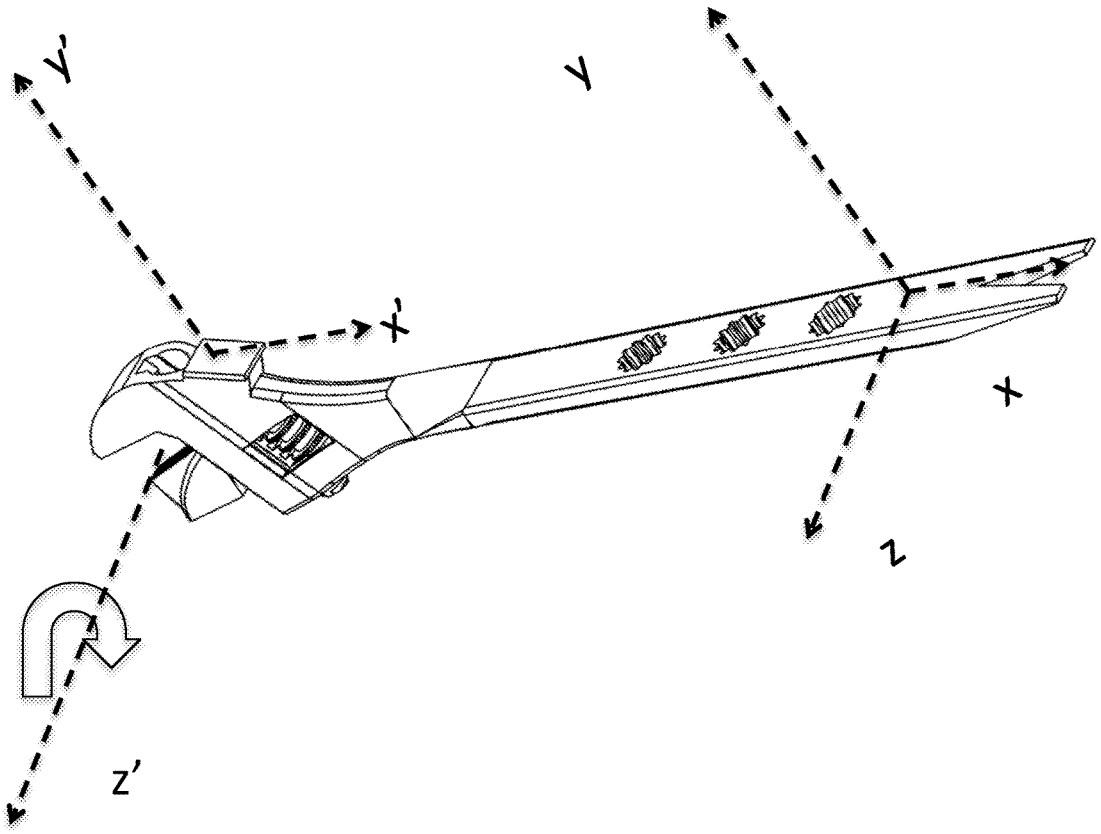
FIG. 8 is an illustration of a rotation of the wrench head.

Further, a gripping portion is defined on an outer surface of a stationary jaw 26 of the wrench head. As illustrated in FIG. 6, a hand is holding a wrench head while using the wrench apertures. In this manner, the user is provided with a firm grip for operating any of the plurality of wrench apertures. The gripping portion may further comprise surface friction structures so that the outer surface provides a gripping texture.

The wrench includes a twisted joining member disposed between the wrench head and the wrench handle. The twisted joining member is positioned such that a user's thumb can rest comfortably on the twist portion while holding the gripping portion of the wrench head while operating the wrench apertures.

Hammer

In a fourth aspect of the present invention, the multifunctional hand tool comprises a hollow hammer head. The hollow hammer head is integrally extended from the wrench head to define the closed end of the sliding channel within the wrench head. The hammer head has a hammer face integrally formed at a peripheral surface of the wrench head to provide an added function of the wrench head.

In one embodiment, the hollow hammer head is square shaped. In another embodiment, the hollow hammer head is round shaped. Said hammer face is formed at said peripheral surface of said closed end of said sliding channel.

The hammer head moves along a plane defined by x and y axes. In one example, the hammer head, has a flat surface. In another example, the hammer head has a surface not completely flat.

The wrench handle can further includes gripping features on its outer surface to facilitate the use of hammer head.

The wrench head, including the stationary jaw, movable jaw, screw drive, hollow hammer head are integrally formed with the elongated handle.

Nail Puller

The nail puller moves along the plane defined by a axis and y axis. In one embodiment, the nail puller moves in a direction counter to the movement direction of the hammer head. In one example, the hammer head evolves counter clock-wise around the z axis, and nail pull evolves clockwise around the z axis.

Operable Use

In one embodiment of the present invention, the multifunction tool is used as a wrench, either as an adjustable wrench or a pipe wrench to tighten and loosen nuts, bolts, screws, and pipes. In one example, a user holds the wrench handle and When places the wrench on a nut. The movable jaw is adjusted to fit the wrench opening with the size of the nut and put pressure on the stationary jaw. The movable jaw is placed on the side towards which the rotation of the wrench head is to be performed. The rotation of the wrench head defines a pivotal arc, wherein the pivotal arc is in the plane formed by x and y axis. The wrench head is rotation or evolving around z axis.

It should be appreciated from the foregoing that the present invention provides a multifunctional hand tool, which is substantially in a form of a wrench having an adjustable wrench head and an elongated handle extending from the wrench head. The handle is oriented transverse to the wrench head and that defines a plurality of wrench apertures of different sizes. Each wrench aperture defines an axis of rotation (y axis or axis parallel to y axis) for operable use oriented substantially transverse to the first axis of rotation (around z axis). The wrench head further comprises a hammer and the elongated handle further comprises a nail pull structure. The wrench head can further include a grip texture on an outer surface thereof to facilitate use of the wrench apertures or the nail pull defined by the wrench handle. The outer surface of the handle further includes grip features or textures to facilitate use of the hammer. The adjustable wrench can be changed to a pipe wrench.

Although the invention has been disclosed in detail with reference only to the exemplary embodiments, those skilled in the art will appreciate that various other embodiments can be provided without departing from the scope of the invention. Accordingly, the invention is defined only by the claims set forth below.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Furthermore, for ease of understanding, certain method procedures may have been delineated as separate procedures; however, these separately delineated procedures should not be construed as necessarily order dependent in their performance. That is, some procedures may be able to be performed in an alternative ordering, simultaneously, etc. In addition, exemplary diagrams illustrate various methods in accordance with embodiments of the present disclosure. Such exemplary method embodiments are described herein using and can be applied to corresponding apparatus embodiments, however, the method embodiments are not intended to be limited thereby.

Although few embodiments of the present invention have been illustrated and described, it would be appreciated by those skilled in the art that changes may be made in these embodiments without departing from the principles and spirit of the invention. The foregoing embodiments are therefore to be considered in all respects illustrative rather than limiting on the invention described herein. Scope of the invention is thus indicated by the appended claims rather than by the foregoing description, and all changes which come within the meaning and range of equivalency of the claims are intended to be embraced therein. Terms in the claims should be given their broadest interpretation consistent with the general inventive concept as set forth in this description. As another example, "having" and "including", derivatives thereof and similar transitional terms or phrases are used synonymously with "comprising" (i.e., all are considered "open ended" terms)—only the phrases "consisting of" and "consisting essentially of" should be considered as "close ended".

What is claimed is:

1. A three-dimensional hand tool in a shape substantially resembling a wrench, comprising:

a wrench head, comprising a stationary jaw comprising a first engaging surface, a movable jaw opposite the stationary jaw, movable in a sliding channel, comprising a second and a third engaging surface, and wherein the movable jaw is de-attachable from the wrench head, a hammer head, integrally extended from the wrench head to define the closed end of the sliding channel within the wrench head, a cavity with a periphery, having a substantially a semi-circle connected with a half square, and a radius of the semi-circle is greater than an half of a length of the square, and the cavity with a periphery is between the hammer head and wrench head surface bearing the stationary jaw but opposite to the first engaging surface;

an elongated wrench handle, comprising a plurality of wrench apertures of different sizes, and a v shaped nail pull structure positioned at the end of the elongated wrench handle and a joining member that joins the wrench head with the wrench handle in a unitary construction, wherein the elongated wrench handle has a grip texture comprising surface friction structures.

2. The hand tool as in claim 1, wherein the hand tool has three axes, a first axis, defined by the elongated wrench handle and the tip of the v-shaped nail pull structure thereof and the first axis is substantially parallel to the length of the elongated handle, a second axis, a y-axis, which is substantially perpendicular to the x axis and perpendicular to a width of the elongated handle, and a third axis, z-axis, is parallel to the width of elongated wrench handle and perpendicular to x axis, wherein the operable use of the hand tool includes a rotation around an axis parallel to z-axis.

3. The hand tool as in claim 1, wherein when the second engaging surface faces the first engaging surface such that the wrench functions as an adjustable wrench.

4. The hand tool as in claim 3, wherein the adjustable wrench is changed into a pipe wrench by de-attaching the movable jaw and re-attaching the movable jaw through the sliding channel.

5. The hand tool as in claim 1, wherein when the third engaging surface faces the first engaging surface such that the wrench functions as a pipe wrench.

6. The hand tool as in claim 1, wherein the wrench head further provides grip texture on the outer surface of the stationary jaw.

7. The hand tool as in claim 1, wherein the wrench apertures have spline designs, allowing each aperture fit in both a SAE and metric sized element.

8. The hand tool as in claim 1, wherein the hammer head is flat.

9. The hand tool as in claim 1, wherein the third engaging surface has grip textures.

10. The hand tool as in claim 1, wherein the thickness of the wrench handle is between 5-10 mm.

11. The hand tool as in claim 1, wherein one of the apertures accommodates a 12 mm element.

12. The hand tool as in claim 1, wherein one of the apertures accommodates a 14 mm element.

13. The hand tool as in claim 1, wherein one of the apertures accommodates a 17 mm element.

14. The hand tool as in claim 1, wherein one of the apertures accommodates a 15/32 inch element.

15. The hand tool as in claim 1, wherein one of the apertures accommodates a 9/16 inch element.

16. The hand tool as in claim 1, wherein one of the apertures accommodates an 11/16 inch element.

17. method of using a hand tool, comprising providing a hand tool of claim 1, operating the hand tool, comprising providing a wrench head having the second engaging surface of the movable jaw facing the first engaging surface of the stationary jaw, de-attaching the movable jaw from the wrench head, replacing the movable jaw back onto the wrench head having the third engaging surface of the movable jaw facing the first engaging surface of the stationary jaw.

* * * * *